US011739887B2

(12) United States Patent
Van Bommel et al.

(10) Patent No.: US 11,739,887 B2
(45) Date of Patent: Aug. 29, 2023

(54) LIGHTING DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL); Johannes Petrus Maria Ansems, Hulsel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/765,302

(22) PCT Filed: Oct. 5, 2020

(86) PCT No.: PCT/EP2020/077846
§ 371 (c)(1),
(2) Date: Mar. 30, 2022

(87) PCT Pub. No.: WO2021/069374
PCT Pub. Date: Apr. 15, 2021

(65) Prior Publication Data

US 2022/0373140 A1 Nov. 24, 2022

(30) Foreign Application Priority Data

Oct. 10, 2019 (EP) ..... 19202373

(51) Int. Cl.
*F21K 9/232* (2016.01)
*F21K 9/69* (2016.01)
*F21Y 107/40* (2016.01)

(52) U.S. Cl.
CPC ..... *F21K 9/232* (2016.08); *F21K 9/69* (2016.08); *F21Y 2107/40* (2016.08)

(58) Field of Classification Search
CPC ... F21K 9/232; F21K 9/69; F21K 9/68; F21Y 2107/40; F21Y 2115/10
See application file for complete search history.

(56) References Cited

U.S. PATENT DOCUMENTS 8,534,880 B1 9/2013 Berg et al.
9,410,687 B2 * 8/2016 Hussell ..... F21V 29/773
(Continued)

FOREIGN PATENT DOCUMENTS

CN 202733556 U 2/2013
CN 203176869 U 9/2013
(Continued)

*Primary Examiner* — Evan P Dzierzynski

(57) ABSTRACT

A lighting device (1) is provided. The lighting device comprises at least two light-emitting diode, LED, filaments (11). The lighting device further comprises at least two optical modules (12). Each optical module (12) is arranged in relation to a corresponding one of the LED filaments (11) to receive light emitted by the corresponding one of the LED filaments (11). Each optical module (12) is configured to collimate the received light and produce a collimated light beam so as to increase the degree of collimation of the light produced by the optical module (12) as compared to the light received by the optical module (12). The light produced by each optical module (12) is emitted from the lighting device (1). Further, the optical modules (12) are arranged in relation to each other such that collimated light beams of the respective ones of the optical modules (12) are oriented in different directions.

14 Claims, 5 Drawing Sheets

(56) References Cited

U.S. PATENT DOCUMENTS

| | | | | |
|---|---|---|---|---|
| 2007/0080645 | A1 | 4/2007 | Smith | |
| 2012/0081880 | A1* | 4/2012 | Narendran | F21V 9/45 362/293 |
| 2015/0308633 | A1 | 10/2015 | Van de Ven et al. | |
| 2017/0130906 | A1* | 5/2017 | Jiang | H01L 33/62 |
| 2018/0100624 | A1 | 4/2018 | Bergenek et al. | |

FOREIGN PATENT DOCUMENTS

| | | | |
|---|---|---|---|
| CN | 208154135 | U | 11/2018 |
| EP | 3276254 | A1 | 1/2018 |
| WO | 2018041826 | A1 | 3/2018 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2020/077846, filed on Oct. 5, 2020, which claims the benefit of European Patent Application No. 19202373.7, filed on Oct. 10, 2019. These applications are hereby incorporated by reference herein.

TECHNICAL FIELD

The present invention is related to a lighting device comprising at least two light-emitting diode (LED) filaments and at least two optical modules, for producing at least two collimated light beams which are oriented in different directions.

BACKGROUND

LED-based lighting is increasingly replacing incandescent lamps in most fields of use. However, many users still enjoy the appearance of incandescent lamps, but still want to enjoy the benefits which come with switching to LED-based lamps and lighting. This has created the solution of creating LED lamps and bulbs that resemble the appearance of incandescent lamps, luminaires and bulbs, wherein the wire filament is replaced with LED light sources. Known concepts include LEDs sealed or covered by a component to produce the appearance of filaments, of various shapes, inside a transparent or translucent bulb. The LED filament(s) are further connected to a LED module, which may comprise electrical wiring and/or a power supply. Solutions according to, or similar, to the concept mentioned above are generally able to produce intended effect of the emitted light resembling that of an incandescent lamp. However, the shadows produced due to light emitted by solutions according to, or similar, to the concept mentioned may not resemble the shadows produced due to light emitted by incandescent lamps.

SUMMARY

In view of the above discussion, a concern of the present invention is to provide a LED-based light-emitting device, which may produce shadows resembling shadows produced due to light emitted by incandescent lamps and/or collimated omnidirectional light. Further, with the use of LED-based lighting instead of incandescent lamps, it may be a concern of the present invention to be able to address different LED lighting elements, such as LED filaments, in order to provide a capability to create dynamic shadows.

To address at least one of these concerns and other concerns, a light-emitting device in accordance with the independent claim is provided. Preferred embodiments are defined by the dependent claims.

According to an aspect of the present invention, a lighting device is provided. The light-emitting device comprises at least two light-emitting diode (LED) filaments and at least two optical modules. Each optical module is arranged in relation to a corresponding one of the LED filaments to receive light emitted by the corresponding one of the LED filaments. Each optical module is configured to collimate the received light and produce a collimated light beam so as to increase the degree of collimation of the light produced by the optical module as compared to the light received by the optical module. The light produced by each optical module is emitted from the lighting device. The optical modules are arranged in relation to each other such that collimated light beams of the respective ones of the optical modules are oriented in different directions.

The lighting device may further comprise a light transmissive envelope and a cap. The light transmissive envelope may comprise a light bulb and, wherein the cap may be configured to mechanically and electrically connect the light bulb to a luminaire. The term "cap" may be understood as socket or lamp connector. The lighting device may be mechanically and electrically connected to a luminaire, wherein the luminaire may comprise transparent and non-transparent areas. The term "non-transparent" may be understood as light reflecting or light absorbing. The light transmissive envelope may comprise a material with a higher thermal conductivity than the lighting device.

A lighting device comprising at least two LED filaments, each with a corresponding optical module arranged in relation to the LED filament receive light emitted by the corresponding LED filament, may produce light wherein the direction or orientation of collimated light beams may be tailored as desired or required. The possibility to tailor the directionality of the collimated light beams may increase the attainable degree of omni-directionality of the light emitted by the lighting device. The possibility to tailor the directionality of the collimated light beams may be provide the capacity or capability to produce shadows with specified characteristics, such as non-overlapping shadows. Due to the collimated light beams of the respective ones of the optical modules being oriented in different directions, a collimated light beam that is producing a shadow of an object may be the only collimated light beam that is producing a shadow of that object, and shadows with specified characteristics may be obtained. If the lighting device is placed in a luminaire with holes or a lamp shade, then non-overlapping shadows or "perfect" shadows may be produced.

A LED filament is providing LED filament light and comprises a plurality of light emitting diodes (LEDs) arranged in a linear array. Each LED filament of the lighting may comprise a plurality of emitting diodes (LEDs) arranged in a linear array. Preferably, the LED filament has a length L and a width W, wherein L>5 W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. Thus, the first major and/or the second major surface may be partly covered by the encapsulant. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

Each optical module may be arranged in relation to a corresponding one of the LED filaments to only receive light emitted by the corresponding one of the LED filaments. The at least two optical modules may each comprise an optical axis, wherein the optical axes may be arranged in different directions. The at least two optical modules may be arranged such that they are facing outward with regards to a longitudinal axis of the lighting device. By the term "collimation" it is in the context of the present application meant to make part of the light rays mutually parallel and/or reduce mutually angles between part of the light rays. Increasing the degree of collimation may mean narrowing the beam of light. Thus, increasing the degree of collimation may for example narrow the beam of light from omnidirectional light to, e.g., 25 degrees full-width-half-max (FWHM). The at least two optical modules may each produce a beam of light with a corresponding FWHM angle. The beams of light may overlap their corresponding neighbors. The at least two optical modules may be configured to produce a beam of light with a different FWHM, thereby changing the overlap of the beams of light. Light emitted by the lighting device may have a higher degree of collimation than light emitted by a LED filament which is not arranged in relation to a corresponding optical module. The degree of collimation may be in a range from above that of light emitted by a LED filament which is not arranged in relation to a corresponding optical module to perfectly collimated light. The at least two LED filaments may be arranged in relation to a corresponding one of the optical modules such that the light emitted by the LED filaments is either received by the optical module or emitted from the lighting device, wherein the light emitted from the lighting device may be comprised in the collimated light beam. In other words, the at least two LED filaments may be arranged in relation to a corresponding one of the optical modules such that the light emitted does not intersect, or overlap, with light emitted from another LED filament.

The optical modules may for example be arranged in relation to each other such that a collimated light beam produced by one optical module does not overlap with a collimated light beam produced by another optical module.

The optical modules may for example be arranged in relation to each other such that preferably less than 10% of a collimated light beam produced by one optical module does not overlap with a collimated light beam produced by another optical module. Further, the optical modules may for example be arranged in relation to each other such that more preferably less than 5% of a collimated light beam produced by one optical module does not overlap with a collimated light beam produced by another optical module. Furthermore, the optical modules may for example be arranged in relation to each other such that most preferably less than 3% of a collimated light beam produced by one optical module does not overlap with a collimated light beam produced by another optical module.

A part of the light emitted by each LED filament may be emitted, in an outward direction from a longitudinal axis of the lighting device, and the rest of the light emitted by each LED filament may be received by an optical module corresponding to each LED filament. The collimated light beam may comprise the light emitted by a LED filament and the light produced by its corresponding optical module.

The number of LED filaments and the number of optical modules may for example be in the range from 3 to 14, more preferably from 5 to 12, most preferably from 6 to 10.

Thus, the number of LED filaments may for example be in the range from 3 to 14, or more preferably from 5 to 12, or most preferably from 6 to 10. Further, the number of optical modules may for example be in the range from 3 to 14, or from 5 to 12, or from 6 to 10.

The at least two optical modules may be arranged at an angle $\Theta$ in relation to a longitudinal axis of the lighting device, wherein $\Theta$ is different from 0.

The at least two optical modules are preferably arranged at an angle $\theta$ in the range from 10 to 60 degrees, more preferably 15 to 50 degrees, most preferably 20 to 45 degrees in relation to the longitudinal axis of the lighting device. The at least two optical modules are preferably not arranged parallel to the longitudinal axis of the lighting device. The at least two optical modules are preferably not arranged perpendicular to the longitudinal axis of the lighting device. However, the at least two optical modules may be arranged parallel to the longitudinal axis of the lighting device. Each of at least two optical modules may for example be arranged at a distance from a longitudinal axis of the lighting device. Each of the at least two optical modules may for example have an elongated shape. Each of the at least two optical modules may be arranged such that one side of the optical module is closer to the longitudinal axis than the other side of the optical module. Each of the at least two optical modules may be arranged in a tilted position with regards to the longitudinal axis of the lighting device. The at least two LED filaments may be arranged in relation to their corresponding optical module in relation to the longitudinal axis of the lighting device. However, the at least two optical modules may be arranged parallel, or substantially parallel, to a longitudinal axis of the lighting device. If the at least two optical modules are arranged parallel, or substantially parallel, to a longitudinal axis of the lighting device, the collimated light beam may have a direction which may be perpendicular, or substantially perpendicular, to the longitudinal axis of the lighting device. The at least two optical modules may have a rectangular, square, substantially square, or quadrilateral shape.

The lighting device may comprise a controller. The controller may be configured to individually control at least one of an intensity and a color of the light emitted by each LED filament. The intensity of the light emitted by the LEDs filament may be controlled individually. Thus, the intensity of the light emitted by each of the LEDs filament may be controllable. The lighting device may comprise a driver. The controller and/or the driver may be arranged may be arranged in a base of the lighting device. Thus, the controller and/or the driver may be hidden from view of a user.

The lighting device may be configured to produce collimated light beam patterns. The intensity of the light emitted by each LED filament may be controlled to range from emitting no light to emitting the maximum amount of light possible for the LED filament. The intensity of the light emitted by the LED filaments may be controlled such that a certain collimated light beam pattern is obtained. A collimated light beam pattern may be obtained by that every other, or third, or fourth, or fifth, LED filament, emits light at a higher, or lower, intensity than the rest of the LED filaments. Another collimated light beam pattern may be obtained by that a number of LED filaments are in an on-state, while the rest are in an off-state. Thereby, the lighting device may be further configured to produce dynamic shadows. The dynamic shadows may be produced by controlling each LED filaments to emit light with intensity and/or color according to a determined pattern. Further, the dynamic shadows may be produced by controlling the orientation of different optical modules. The color of the light emitted by the LED filaments may be controlled individually. Thus, the color of the light emitted by each of the LED filaments may be controllable. Each LED filament may be individually color tunable. The lighting device may be configured to produce collimated light beam patterns, wherein the light of different collimated light beams may have one or more selected colors. A collimated light beam pattern may be obtained by that every other, or third, or fourth, or fifth, LED filament emits light with a different color than the rest of the LED filaments. Thereby, the lighting device may be further configured to produce color controlled dynamic shadows. The lighting device may be configured to produce white light, wherein the produced white light has a color temperature in the range from 1800 to 4000 K. The lighting device may produce light, wherein the produced light has a color rendering index (CRI) above 75, more preferably above 80, most preferably above 85.

Each or any of the at least two optical modules may for example comprise or be constituted by, or be configured as, a reflector.

The reflector(s) may for example comprise or be constituted by, or be configured as, linear reflector(s). Each reflector may be arranged in between a longitudinal axis of the light-emitting device and its corresponding LED filament. The reflector may be arranged in relation to a corresponding one of the LED filaments to receive the light emitted by the corresponding one of the LED filaments, wherein each reflector may be configured to collimate the received light and reflect a collimated light beam so as to increase the degree of collimation of the light produced by the optical module as compared to the light received by the optical module. Each LED filament may be recessed in a corresponding reflector (e.g., each LED filament may be arranged in a recess in a corresponding reflector). The at least two reflectors may differ in shape. A lighting device comprising reflectors of differing shapes may produce a different decorative light effect. The different decorative light effect may be produced due to the different spatial light distributions produced by a lighting device comprising reflectors which differs in shape. The reflection of the inner side of the at least two reflectors is preferably specular reflection. The reflection of the at least two reflectors is preferably at least 80%, more preferably at least 85%, most preferably at least 90%.

The at least two reflectors may be elongated. The at least two LED filaments may be arranged in the elongated direction of its corresponding reflector.

Each or any of the at least two reflectors may for example comprise or be constituted by, or be configured as, a parabolic reflector.

This may facilitate achieving a desired degree of collimation of light. A LED filament may be arranged in an optical center of its corresponding reflector, which may further increase the degree of collimation. In the context of the present application, by an optical center it is meant as a position which may be located, or substantially located, at the focal point of the optical module. In other words, an optical center may be a position onto which collimated light parallel to an axis of the optical module is focused. The at least two parabolic reflectors may be arranged such that their openings are facing outward from the longitudinal axis of the lighting device. Each of the at least two elongated reflectors may be configured as parabolic reflectors at least in a cross-section of the elongated reflectors.

Each or any of the at least two reflectors may for example have a trapezoidal shape.

The parallel, or substantially parallel, sides of the trapezoidal shape may be arranged perpendicularly, or substantially perpendicular, to the longitudinal axis of the lighting device.

The at least two parabolic reflectors may have a trapezoidal shape, and each of them may be arranged in relation to its corresponding LED filament in such a way that the corresponding LED filament is arranged in an optical center of the parabolic reflector. Possibly, a parabolic reflector is arranged in a tilted orientation with respect to its corresponding LED filament.

It is to be understood that a trapezoidal shape is exemplifying, and that each or any of the at least two reflectors may have another shape than a trapezoidal shape.

Each or any of the at least two optical modules may for example comprise or be constituted by, or be configured as, a lens.

Each LED filament may be arranged in between a longitudinal axis of the light-emitting device and its corresponding lens. The lenses may be arranged in front of the LED filament with regards to a longitudinal axis of the light-emitting device. The at least two lenses may be configured as linear lenses. The lenses may be transparent or invisible to the naked eye of a person viewing the light-emitting device from a distance, e.g., a distance of one or a few meters.

Each LED filament may be arranged in an optical center of its corresponding optical module.

The at least two optical modules may for example be comprised in a monolithic optical element.

The at least two optical modules may for example be comprised in at least one solid element, or formed as a single piece.

Each or any of the at least two reflectors may have a length Lr. Lr may for example be in the range from 2 to 12 cm, or more preferably from 3 to 10 cm, or most preferably from 4 to 8 cm.

Each or any of the at least two LED filaments may have a length Lf. Lf may for example be in the range from 0.5 Lr to 0.95 Lr, or from 0.6 Lr to 0.95 Lr, or from 0.8 Lr to 0.95 Lr.

The full width at half maximum (FWHM) of the collimated light beam produced by each optical module may for example be in the range of 360°/(N*2) to 360°/(N), or in the range from 360°/(N*1.8) to 360°/(N*1.2), or in the range from 360°/(N*1.6) to 360°/(N*1.4), wherein N is the number of optical modules.

The FWHM of a collimated light beam may be understood as the angle of a beam which comprises the light of the collimated light beam which has an intensity equal to or above 50% of the maximum intensity of the collimated light beam. The FWHM may be understood as the beam angle of light produced by an optical module. The FWHM is preferably <30 degrees, more preferably <25 degrees, most preferably <20 degrees.

The lighting device may be configured such that when viewed by a viewer using the naked eye from a distance of for example 1 m, 2 m, or 5 m, at least two LED filaments are perceivable by the viewer.

The at least two LED filaments may be arranged in relation their corresponding optical modules such that each LED filament may only be visible to the viewer from certain angles.

BRIEF DESCRIPTION OF THE DRAWINGS

Exemplifying embodiments of the invention will be described below with reference to the accompanying drawings.

Figure 1:
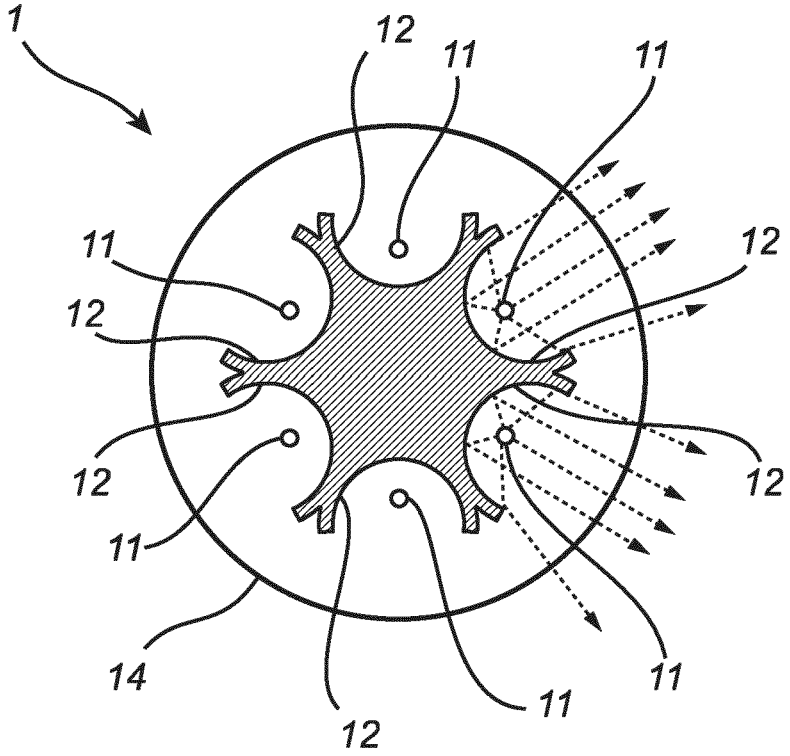
FIG. 1 is a schematic view of a cross-section of a lighting device perpendicular to a longitudinal axis of the lighting device, according to one or more exemplifying embodiments of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

FIG. 1 is a schematic view of a cross-section of a lighting device 1 in a plane perpendicular to a longitudinal axis of the lighting device 1, according to one or more exemplifying embodiments of the present invention. FIG. 1 shows a lighting device 1 comprising six LED filaments 11 and one monolithic optical element 22, which comprises six optical modules 12. It should be noted that the number of LED filaments 11 is purely exemplary, and that the inventive concept is in no way limited by the illustration. For example, the lighting device may comprise any number of LED filaments 11, it may for example be in the range from 3 to 14, from 5 to 12, or from 6 to 10. Each LED filaments 11 is arranged inside an optical center of a corresponding optical module 12. The number of optical modules comprised in the lighting device 1 is not limited to the number shown in FIG. 1. The number of optical modules comprised in the lighting device 1 may for example be in the range from 3 to 14, from 5 to 12, or from 6 to 10. The monolithic optical element 22 is arranged in the center of the lighting device 1. The two right-most LED filaments 11 are shown with five dashed arrows, which represents emitted rays of light, extending from their respective LED filaments 11. Out of the five illustrated dashed arrows, two can be seen to be received by an optical module 12. The dashed arrows, representing emitted rays of light, is then seen to be collimated by the optical module 12, which is configured as a reflector. The lighting device 1 is illustrated as being arranged inside a light transmissive envelope, which in accordance with the illustrated embodiment of the present invention is comprised in or constituted by a light bulb 14. The lighting device 1 may hence be comprised in a light bulb 14.

Figure 2A:
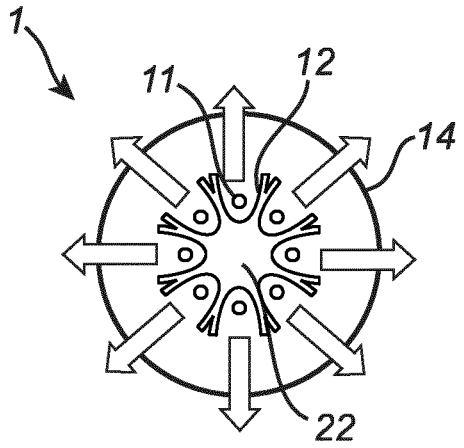
FIGS. 2*a*-2*d* are schematic views of four cross-sections of lighting devices perpendicular to longitudinal axes of the lighting devices according to an exemplifying embodiment of the present invention.
Figure 2B:
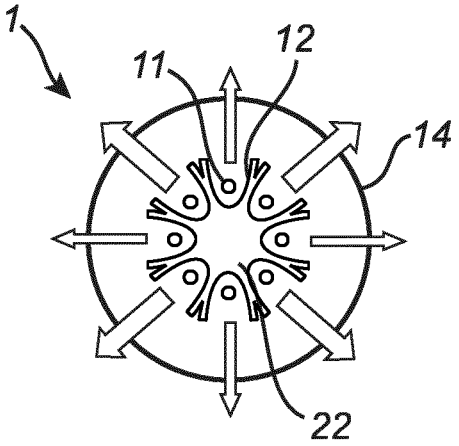
Figure 2C:
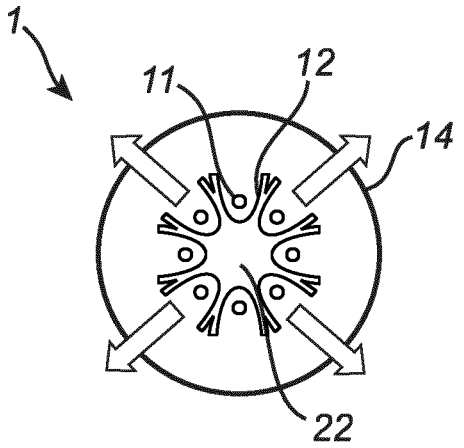
Figure 2D:
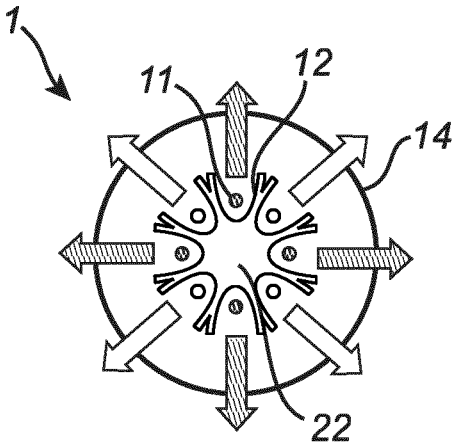

FIG. 2*a*-2*d* are schematic views of four cross-sections of lighting devices 1 perpendicular to longitudinal axes of the lighting devices 1 according to an exemplifying embodiment of the present invention. FIG. 2*a* shows a lighting device 1 comprising eight LED filaments 11 and one monolithic optical element 22, which comprises eight optical modules 12. Each LED filaments 11 is arranged inside an optical center of a corresponding optical module 12. The monolithic optical element 22 is arranged in the center of the lighting device 1. Further, FIG. 2*a* shows eight arrows arranged from a respective LED filament 11 in an outward direction with regards to a central axis of the lighting device 1. It should be noted that the numbers of LED filaments 11 and optical modules 12 is purely exemplary, and is not limited to eight. There number of LED filaments and/or optical modules may for example be in the range from 3 to 14, or 5 to 12, or 6 to 10. The optical modules 12 are illustrated in FIGS. 2*a*-2*d* as being configured as parabolic reflectors. However, the optical modules 12 are not limited thereto, and may be configured as reflectors (parabolic reflectors or some other type of reflectors) and/or lenses, for example. FIG. 2*b* shows a lighting device 1 comprising all the features of the lighting device 1 shown in in FIG. 2*a*, except that every other arrow, arranged from a respective LED filament 11 in an outward direction with regards to a central axis of the lighting device 1, has a smaller size. The differing size of arrows may indicate a collimated light beam pattern with regards to collimated light beam intensity. FIG. 2*c* shows a lighting device 1 comprising all the features of the lighting device 1 shown in in FIG. 2*a* and FIG. 2*b*, except that every other LED filament 11 is in an off-state. FIG. 2*d* shows a lighting device 1 comprising all the features of the lighting device 1 shown in in FIGS. 2*a*-2*c*, except that every other arrow, arranged from a respective LED filament 11 in an outward direction with regards to a central axis of the lighting device 1, is emitting light with a different color than the other LED filaments 11. Thereby, a collimated light beam pattern with regards to color is shown. Similar to the lighting device 1 illustrated in FIG. 1, the lighting devices 1 illustrated in FIGS. 2*a*-2*d* are arranged inside a light transmissive envelope, which in accordance with the illustrated embodiments of the present invention is comprised in or constituted by a light bulb 14.

Figure 3A:
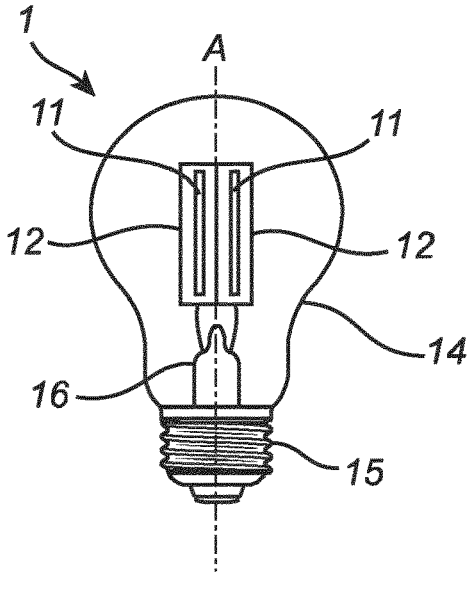
FIGS. 3*a*-3*b* are schematic views of a lighting device according to one or more exemplifying embodiments of the present invention.
Figure 3B:
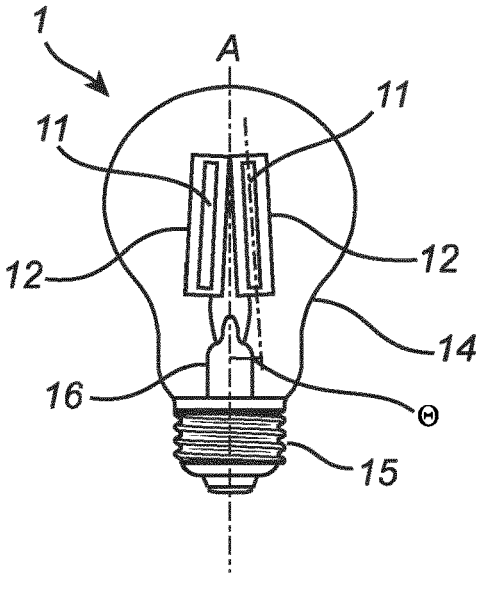

FIG. 3*a*-3*b* are schematic views of a lighting device 1 according to one or more exemplifying embodiments of the present invention. FIG. 3*a* shows a lighting device 1 comprising at least two LED filaments 11 and at least two optical modules 12, which are shown to be arranged inside a light bulb 14. The at least two optical modules 12 are shown to be elongated and the at least two LED filaments are shown to be arranged in the elongated direction of its corresponding reflector. The shown light bulb has the appearance of a traditional incandescent light bulb, and is configured to be mounted in a conventional socket. However, the light-emitting filament wire of a traditional incandescent light bulb is shown to have been replaced by the at least two LED filaments 11 and at least two optical modules 12. The lighting device 1 illustrated in FIGS. 3*a* and 3*b* comprises a base 15, which for example may comprise an Edison screw base, as illustrated, or a bayonet fitting, or another type of connection known in the art. In accordance with the embodiments of the present invention illustrated in FIGS. 3*a* and 3*b*, the lighting device 1 may comprise some supporting structure 16 for supporting the LED filaments 11 and the optical modules 12 and possibly some other component(s) that may be included in the lighting device 1. Further, the lighting device 1 may include circuitry (not shown in FIGS. 3*a*-3*c*) capable of converting electricity from a power supply to electricity suitable to operate or drive the at least two LED filaments. The circuitry may be capable of at least converting between Alternating Current and Direct Current and converting voltage into a suitable voltage for operating or driving components of the lighting device, such as LED filaments. The at least two LED filaments 11 and at least two optical modules 12 are arranged parallel to a longitudinal axis of the lighting device 1. Each optical module 12 is shown to be arranged between a central axis of the lighting device 1 and a respective LED filament 11. FIG. 3*b* comprises all features shown in FIG. 3*a*. Further, FIG. 3*b* discloses the two LED filaments 11 and the two optical modules 12 as arranged at an angle Θ in relation to a longitudinal axis of the lighting device 1. The lower parts of the two LED filaments 11 and the two optical modules 12 are shown as being arranged at a distance from the central axis of the lighting device 1 which is greater than the distance between the upper parts of the two LED filaments 11 and the two optical modules 12 and the central axis of the lighting device 1.

Figure 3C:
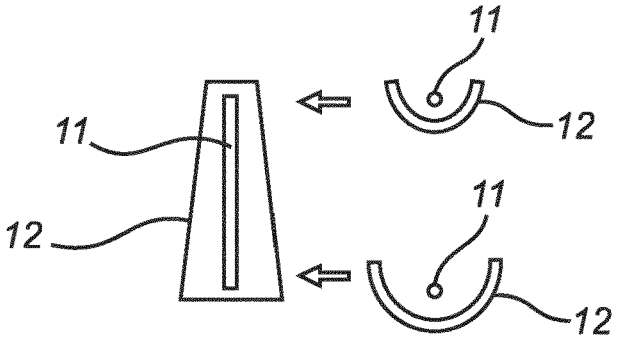
FIG. 3*c* is a schematic view of an optical module an LED filament according to one or more exemplifying embodiments of the present invention.

FIG. 3*c* is a schematic view of an optical module 12 and a LED filament 11 according to one or more exemplifying embodiments of the present invention. To the left, FIG. 3*c* shows a LED filament 11 and an optical module 12, wherein the optical module 12 has a trapezoidal shape. The optical module 12 is shown to be configured to have a parabolic shape. Additionally, to the right of FIG. 3*c* the LED filament 11 and optical module 12 configuration is shown in two schematic views, one upper-right schematic view and one lower-right schematic view, both which show a cross-sectional view of the LED filament 11 and optical module 12 configuration. The upper-right schematic view shows a cross-section of the LED filament 11 and an optical module 12, wherein the optical module 12 has a trapezoidal shape. The LED filament 11 is shown in the upper-right schematic view to be arranged with regards to the parabolic trapezoidal-shaped optical module 12 at a distance d1, such that the LED filament 11 is arranged in an optical center of the optical module 12.

The lower-right schematic view shows a cross-section of the LED filament 11 and an optical module 12, wherein the optical module 12 has a trapezoidal shape. The LED filament 11 is shown in the lower-right schematic view to be arranged with regards to the parabolic trapezoidal-shaped optical module 12 at a distance d2, such that the LED filament 11 is arranged in an optical center of the optical module 12, and where d2>d1. The LED filament 11 is thereby shown in FIG. 3*c* to be arranged in relation to the optical module 12 such that the distance between the LED filament 11 and the optical module 12 is varying along the LED filament 11. The LED filament 11 may be tilted in relation to its respective optical module 12.

Figure 4:
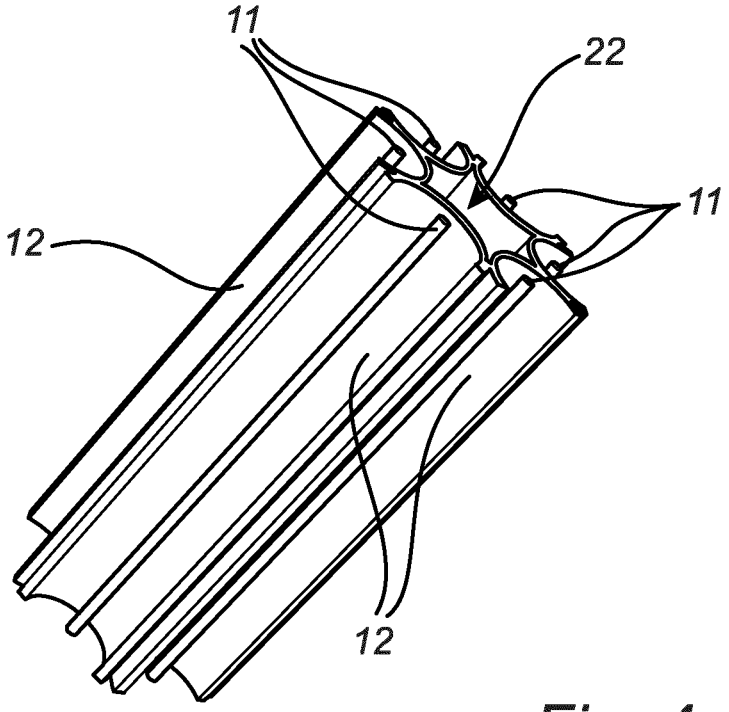
FIG. 4 is a schematic view of a monolithic optical element and LED filaments according to an exemplifying embodiment of the present invention.

FIG. 4 is a perspective view of a monolithic optical element 22 and LED filaments 11 according to an exemplifying embodiment of the present invention. The illustrated monolithic optical element 22 is shown to comprise six optical modules 12. A LED filament 11 is shown as arranged in relation to a corresponding one of the optical modules 12. The monolithic optical element 22 is shown to have a hollow core. However, the optical element 22 may comprise a hole arranged through the monolithic optical element 22. The shown monolithic optical element 22 is exemplary and may comprise any number of optical modules 12 and not only six, such as, for example, in the range from 3 to 14, or 5 to 12, or 6 to 10.

Figure 5:
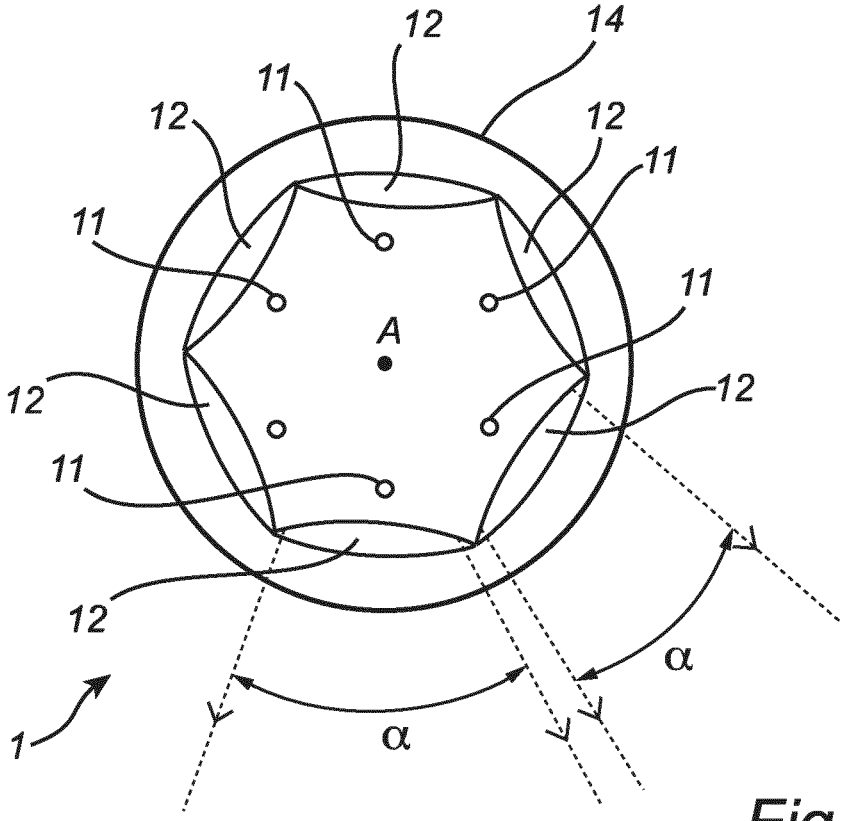
FIGS. 5 and 6 are schematic views of a cross-section of a lighting device perpendicular to a longitudinal axis of the lighting device, according to exemplifying embodiments of the present invention.

FIG. 5 is a schematic view of a cross-section of a lighting device 1 perpendicular to a longitudinal axis of the lighting device 1, according to one or more exemplifying embodiments of the present invention. The lighting device 1 illustrated in FIG. 5 is similar to the lighting device 1 illustrated in FIG. 1. However, while the optical elements 12 in the lighting device 1 illustrated in FIG. 1 comprises reflectors, the optical elements 12 in the lighting device 1 illustrated in FIG. 5 comprises lenses. Possibly, the optical elements 12 may be comprised in a monolithic element, which may be arranged in a center of the lighting device 1. The lighting device 1 illustrated in FIG. 5 comprises six optical modules 12, wherein each LED filament 11 is arranged between a corresponding optical module 12 and the central axis A of the lighting device 1. While the six optical modules 12 in FIG. 5 are configured as lenses, any of the optical modules 12 could be configured as a reflector, for example, such as a parabolic reflector. Thus, the lighting device 1 may comprise several optical elements, wherein at least some may be of different type (e.g., reflector and lens), which applies to all embodiments disclosed herein. The number of optical elements 12 illustrated in FIG. 5 is exemplifying and could in principle be any number. The arrows in FIG. 5 illustrate light rays, and the angles α represent beam angles of the collimated light beams produced by two of the optical modules 12.

Figure 6:
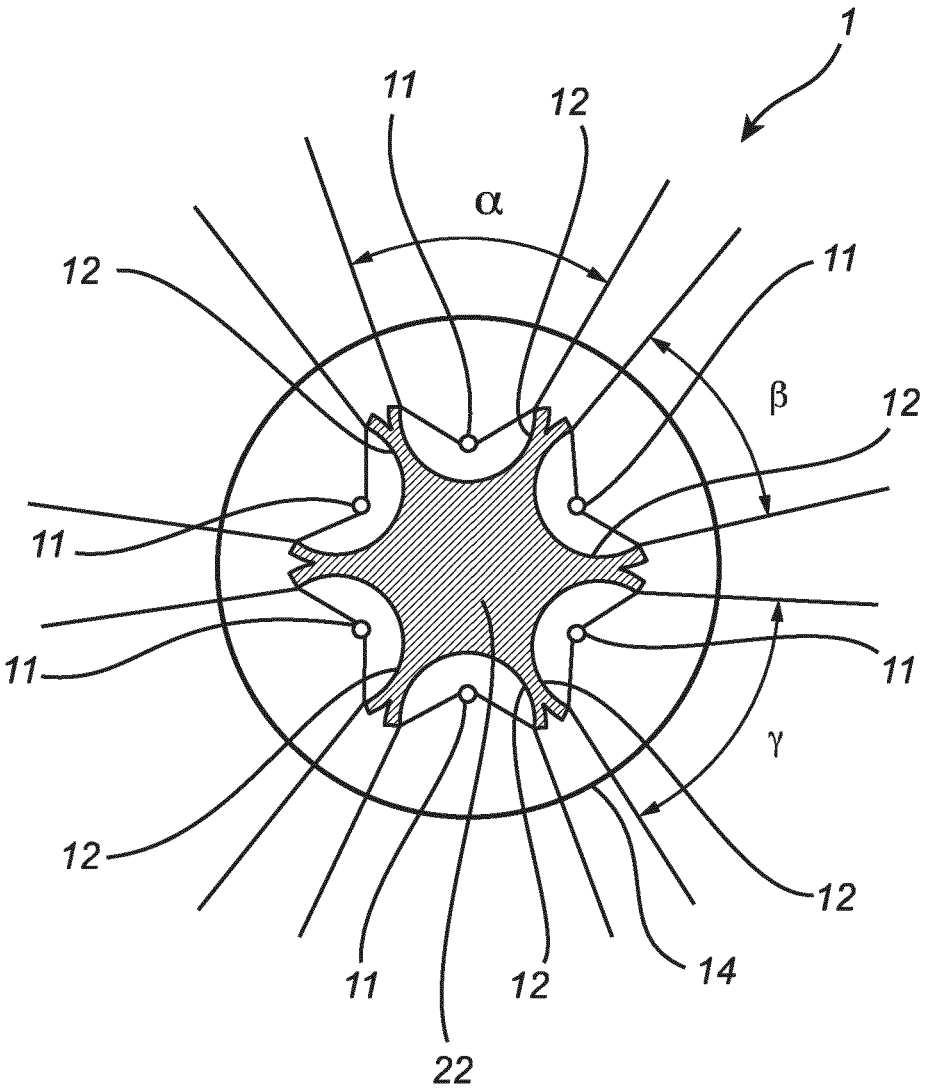

FIG. 6 is a schematic view of a cross-section of a lighting device 1 perpendicular to a longitudinal axis of the lighting device 1, according to one or more exemplifying embodiments of the present invention. The lighting device 1 illustrated in FIG. 6 is similar to the lighting device 1 illustrated in FIG. 1, and the same reference numerals denote the same or similar elements, having the same or similar function. FIG. 6 illustrates that each optical module 12 produces a respective collimated light beam. The arrows in FIG. 6 illustrate light rays, and the angles α, β, γ represent beam angles of the collimated light beams produced by three of the optical modules 12. When seen in the plane of the figure, the collimated light beams may have beam angles such that the sum of the beam angles is less than 360°. However, the sum of the beam angles may possibly be equal to or more than 360°. The collimated light beams in FIG. 6 are such that they are in different directions, such that none of the collimated light beams intersect each other.

In conclusion, a lighting device is provided. The lighting device comprises at least two LED filaments. The lighting device comprises at least two optical modules. Each optical module is arranged in relation to a corresponding one of the LED filaments to receive light emitted by the corresponding one of the LED filaments. Each optical module is configured to collimate the received light and produce a collimated light beam so as to increase the degree of collimation of the light produced by the optical module as compared to the light received by the optical module. The light produced by each optical module is emitted from the lighting device. The optical modules are arranged in relation to each other such that collimated light beams of the respective ones of the optical modules are oriented in different directions.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

at least two light-emitting diode, LED, filaments; and at least two optical modules, each optical module being arranged in relation to a corresponding one of the LED filaments to receive light emitted by the corresponding one of the LED filaments;

wherein each optical module is configured to collimate the received light and produce a collimated light beam so as to increase the degree of collimation of the light produced by the optical module as compared to the light received by the optical module, wherein the light produced by each optical module is emitted from the lighting device, wherein the optical modules are arranged in relation to each other such that collimated light beams of the respective ones of the optical modules are oriented in different directions, and wherein each or any of the at least two optical modules comprise or be constituted by, or be configured as, a lens.

2. A lighting device according to claim 1, wherein the optical modules are arranged in relation to each other such that a collimated light beam produced by one optical module does not overlap with a collimated light beam produced by another optical module.

3. A lighting device according to claim 1, wherein the number of LED filaments and optical modules is in the range from 3 to 14.

4. A lighting device (1) according to claim 1, wherein each of the at least two optical modules is arranged at an angle Θ in relation to a longitudinal axis (A) of the lighting device, wherein Θ is different from 0.

5. A lighting device according to claim 1, further comprising a controller, configured to individually control at least one of an intensity and a color of the light emitted by each LED filament.

6. A lighting device according to claim 1, wherein each of the at least two optical modules comprises a reflector.

7. A lighting device according to claim 6, wherein the at least two reflectors are elongated and the at least two LED filaments are arranged in the elongated direction of its corresponding reflector.

8. A lighting device according to claim 6, wherein each of the at least two reflectors comprises a parabolic reflector.

9. A lighting device according to claim 6, wherein each of the at least two reflectors comprises a trapezoidal shape.

10. A lighting device according to claim 6, wherein each LED filament is arranged in an optical center of its corresponding optical module.

11. A lighting device according to claim 6, wherein each of the at least two reflectors has a length Lr, in the range from 2 to 12 cm, and/or each of the at least two LED filaments has a length Lf, in the range from 0.5 Lr to 0.95 Lr.

12. A lighting device according to claim 1, wherein the at least two optical modules are comprised in a monolithic optical element.

13. A lighting device according to claim 1, wherein the lighting device further comprises a light transmissive envelope and a cap.

14. A lighting device according to claim 1, wherein the full width at half maximum of the collimated light beam produced by each optical module is in the range of 360°/(N*2) to 360°/(N), wherein N is the number of optical modules.

* * * * *